US009028897B2

(12) United States Patent
Nakagiri et al.

(10) Patent No.: US 9,028,897 B2
(45) Date of Patent: May 12, 2015

(54) BEVERAGE EXTRACTION FILTER

(75) Inventors: Osamu Nakagiri, Takatsuki (JP); Akira Okada, Takatsuki (JP); Tomokazu Kimura, Takatsuki (JP)

(73) Assignee: UCC Ueshima Coffee Co., Ltd., Kobe-Shi (JP)

( * ) Notice: Subject to any disclaimer, the term of this patent is extended or adjusted under 35 U.S.C. 154(b) by 0 days.

(21) Appl. No.: 13/809,142

(22) PCT Filed: Jul. 8, 2010

(86) PCT No.: PCT/JP2010/061616

§ 371 (c)(1),
(2), (4) Date: Mar. 11, 2013

(87) PCT Pub. No.: WO2012/004878

PCT Pub. Date: Jan. 12, 2012

(65) Prior Publication Data

US 2013/0209621 A1 Aug. 15, 2013

(51) Int. Cl.
*B65B 29/02* (2006.01)
*B65D 85/804* (2006.01)

(52) U.S. Cl.
CPC ..... *B65D 85/8043* (2013.01)

(58) Field of Classification Search
CPC ..... B01D 23/28; B01D 35/30; B65B 29/02; B65B 29/04; B65B 29/06; B65D 81/00; B65D 85/804; B65D 85/8043; B65D 85/8046; B65D 85/808; B65D 85/812; B65D 85/816; B65D 2203/00; B65D 2203/06; B65D 2565/385; A23F 5/24; A23F 5/26; A23F 5/262; A23F 5/264; A47J 31/00; A47J 31/002; A47J 31/005; A47J 31/02; A47J 31/06; A47J 31/0621; A47J 31/0631; A47J 31/0636; A47J 31/0642; A47J 31/0668; A47J 31/0673; A47J 31/08; A47J 31/10; A47J 31/18; A47J 31/20; A47J 31/3623; A47J 31/369; A47J 31/05; A47J 31/44; A47J 31/4403; A47J 31/4407; A47J 31/446
USPC ..... 426/76–79, 82, 84, 86, 106, 115, 394, 426/431–433; 99/295, 323, 495, 279, 300
See application file for complete search history.

(56) References Cited

U.S. PATENT DOCUMENTS 4,136,202 A * 1/1979 Favre ..... 426/77
4,886,674 A * 12/1989 Seward et al. ..... 426/79

(Continued)

FOREIGN PATENT DOCUMENTS

EP 554469 A1 * 8/1993 ..... B65D 81/00
JP H01-101437 U 7/1989

(Continued)

OTHER PUBLICATIONS

International Preliminary Report on Patentability (PCT/IB/373) issued Feb. 12, 2013, with Written Opinion of the International Searching Authority (PCT/ISA/237), for corresponding international application PCT/JP2010/061616.

(Continued)

*Primary Examiner* — Rena L Dye
*Assistant Examiner* — Chaim Smith
(74) *Attorney, Agent, or Firm* — Law Office of Katsuhiro Arai

(57) ABSTRACT

Disclosed is a beverage extraction filter that can extract in a plurality of extraction machine types. The beverage extraction filter comprises a filter unit (40) where coffee powder is housed and a planar lid unit (41) mounted to the top section of the filter unit (40). The lid unit (41) is formed in a layer structure created by a non-permeable first sheet member (42) positioned on the filter unit side (40) and a permeable second sheet member (43) layered on top of the first sheet member (42), and a hole section (42*a*) through which hot water is made to pass is formed in the center of the first sheet member (42).

16 Claims, 7 Drawing Sheets

(56) References Cited

U.S. PATENT DOCUMENTS

| | | | | |
|---|---|---|---|---|
| 8,272,318 | B2 * | 9/2012 | Skalski et al. | 99/279 |
| 8,468,935 | B2 * | 6/2013 | Skalski et al. | 99/300 |
| 2006/0065127 | A1 * | 3/2006 | Dalton et al. | 99/279 |
| 2007/0259074 | A1 * | 11/2007 | Searchilli et al. | 426/78 |
| 2010/0288131 | A1 * | 11/2010 | Kilber et al. | 99/295 |
| 2011/0151060 | A1 * | 6/2011 | Nakagiri | 426/77 |

FOREIGN PATENT DOCUMENTS

| | | | | |
|---|---|---|---|---|
| JP | H03-123435 U | | 12/1991 | |
| JP | 4278706 | * | 6/2009 | B65D 77/00 |
| JP | 2010-069281 A | | 4/2010 | |

OTHER PUBLICATIONS

Notification of Reasons for Refusal issued by the Japanese Patent Office, mailed Oct. 14, 2012, for Japanese counterpart application No. 2010-535925.

A Notice of Grounds for Rejection issued by the Korean Intellectual Property Office, mailed Feb. 14, 2014, for Korean counterpart application No. 10-2013-7003105.

A Notification of First Office Action with Search Report issued Nov. 15, 2014 by the State Intellectual Property Office of China for Chinese counterpart application No. 201080067657.X.

* cited by examiner (a)

(b)

BEVERAGE EXTRACTION FILTER

TECHNICAL FIELD

The present invention relates to a beverage extraction filter made up of a filter part containing an article consumed for enjoyment, and a flat plate-like lid attached to an upper portion of this filter part.

BACKGROUND ART

Articles that are consumed for enjoyment such as coffee, tea, or green tea may be prepared in a powder form and contained in a beverage extraction filter, which is set at a predetermined position of a beverage extraction machine, so that hot coffee or hot tea can be made by pouring hot water from above (see, for example, Patent Document 1 listed below). While most beverage extraction machines in which beverage extraction filters are set are used mainly in commercial applications, smaller machines for domestic use have also been prevalent.

Typical beverage extraction filters include drip coffee filters and espresso coffee filters, used for extraction of coffee in drip machines and espresso machines, respectively. While drip coffee is made by a commonly known extraction method, espresso coffee is made by a rapid extraction method using high temperature and high pressure. The drip coffee extraction filters and espresso coffee extraction filters thus have different structures, and espresso machines are configured to accommodate only extraction filters dedicated for making espresso coffee.

PRIOR ART DOCUMENT

Patent Document

Patent Document 1: JP-A-2010-069281

SUMMARY OF THE INVENTION

Problems to be Solved by the Invention

Many coffee drinkers like drinking both drip coffee and espresso coffee. Owning dedicated machines for both drip coffee and espresso coffee, however, would be a heavy burden in cost. It would be even more preferable if not only coffee but also tea or green tea can be extracted with the same machine.

The present invention has been made in view of the above circumstances, and an object thereof is to provide a beverage extraction filter that can be used for extraction of beverages in various kinds of extraction machines.

Means for Solving the Problems

In order to solve the above problem, the beverage extraction filter according to the present invention includes a filter part containing an article consumed for enjoyment, and a flat plate-like lid attached to an upper portion of the filter part, wherein the lid is configured to have a laminated structure including a non-water permeable first sheet member located adjacent the filter part, and a water permeable second sheet member laminated on the first sheet member, and the first sheet member has a hole formed in a center thereof for hot water to pass.

The advantageous effects of the beverage extraction filter having such a structure will be explained. The filter is made up of the filter part containing the article consumed for enjoyment and the lid. Here, coffee powder is given as one example of an article that is consumed for enjoyment, and a drip coffee extraction filter configured to be usable also in an espresso machine will be described.

The lid has a characteristic structure, in which the non-water permeable first sheet member and the water permeable second sheet member form a laminated structure. The first sheet member is formed with a hole in the center, and hot water is introduced only through this hole. A drip machine, in which this extraction filter is supposed to be used, is configured such that hot water is poured only over the center of the extraction filter.

On the other hand, an espresso machine is configured such that hot water is poured all over the lid for a rapid extraction with high temperature and high pressure. Drip coffee, however, loses its taste (becomes weak) if hot water is poured all over the filter, therefore hot water needs to be introduced through the center of the filter. Accordingly, the first sheet member is formed with a hole in the center so that hot water will be introduced only from the center in either of the machines mentioned above. A material that does not have water permeability is selected for the first sheet member to prevent hot water from being introduced from other than the hole.

If the lid were formed only of the first sheet member, there would be the following problem. Since hot water is supplied all over the lid in the espresso machine, some hot water that did not pass through the hole may remain on the lid even after the extraction. Such residual hot water may drip down when the extraction filter is taken out of the machine after the extraction. Because of the possibility of hot water contacting the hand, the user will have to take care when handling the filter, which is not user-friendly. In view of this, the second sheet member is laminated on the first sheet member.

The second sheet member has water permeability, so that it can absorb any residual hot water on the lid. Also, the hot water supplied to the edge of the second sheet member can be introduced to the hole in the center through the second sheet member itself. Thereby, the machine will be more user-friendly as there will be no hot water dripping down when the user takes out the extraction filter after the extraction. Thus a beverage extraction filter that can be used in various types of extraction machines can be provided.

In the present invention, the first sheet member and the second sheet member should preferably be laminated upon one another, and bonded together only at a peripheral edge portion.

By bonding the first sheet member and the second sheet member together only at the peripheral edge portion, there can be formed a space therebetween. This space can function as a hot water reservoir. Thus hot water supplied to the edge can be guided to the hole in the center via this space. Any residual hot water can be held in the space, and can be effectively prevented from dripping.

In the present invention, the hole should preferably be formed in a tongue shape by a cut line of a predetermined shape, so that, during extraction, a tongue-shaped portion in the hole deforms downward by pressure from hot water to let the hot water pass through the hole.

As the tongue-shaped hole is formed by a cut line, waste pieces will not be produced during the production process of the hole. Accordingly, the risk of foreign material entrapment during the production process can be reduced.

In the present invention, the second sheet member should preferably be made of a non-woven fabric. By being made of a non-woven fabric, the sheet can let hot water pass through, as well as hold the hot water.

In the present invention, the first sheet member should preferably be formed of a resin film having a multilayer structure. The multilayer structure enables the filter to have desired water permeability and strength.

MODE FOR CARRYING OUT THE INVENTION

Figure 1:
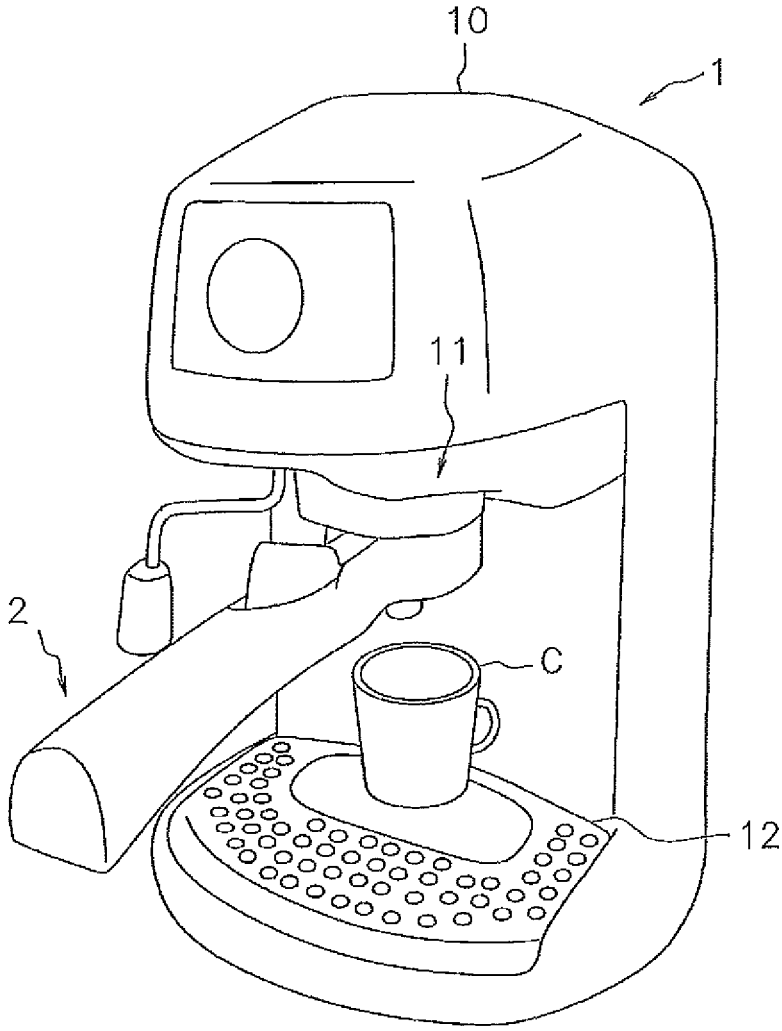
FIG. 1 is a perspective view illustrating the outer appearance and structure of an espresso machine.
Figure 2:
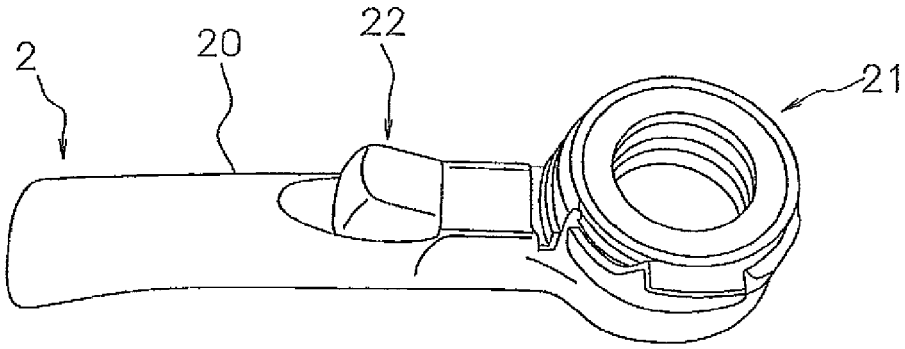
FIG. 2 is a perspective view illustrating the outer appearance and structure of a filter attachment kit.
Figure 3:
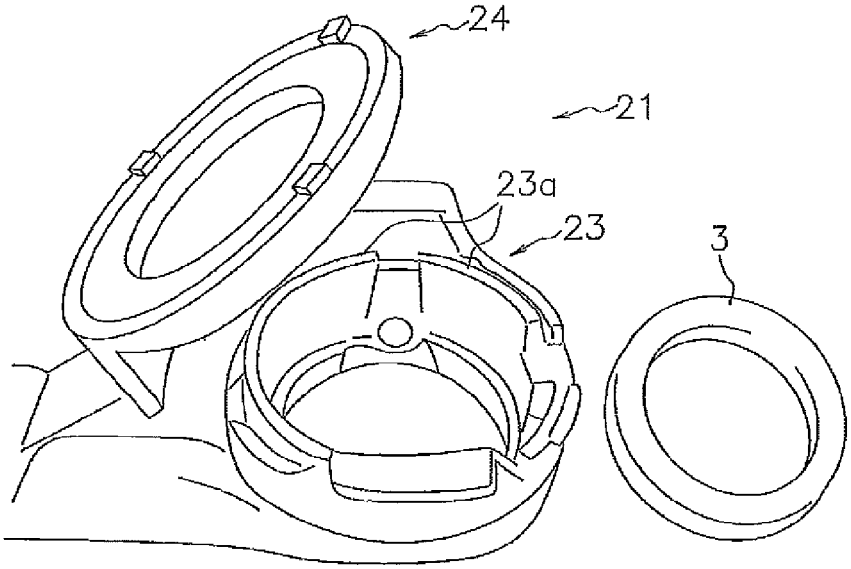
FIG. 3 is an enlarged perspective view illustrating the structure of an essential part of the filter attachment kit.

Preferred embodiments of the beverage extraction filter according to the present invention will be described with reference to the drawings. FIG. 1 is a perspective view illustrating the outer appearance and structure of an espresso machine. FIG. 2 is a perspective view illustrating the outer appearance and structure of a filter attachment kit. FIG. 3 is an enlarged perspective view illustrating the structure of an essential part of the filter attachment kit.

<Structure of Espresso Machine>

In FIG. 1, the espresso machine 1 is a machine for extracting espresso coffee. The machine is typically used for extracting espresso coffee by using an extraction filter for espresso coffee, but drip coffee can also be extracted by attaching an extraction filter for drip coffee according to the present invention (i.e., the beverage extraction filter).

The espresso machine 1 has a main body 10 that allows for removable attachment of a filter attachment kit 2 to a receptacle part 11. A coffee cup C is placed on a tray part 12 to be ready for coffee to be extracted.

As shown in FIG. 2, the filter attachment kit 2 includes a main body 20 to be held by a hand, an attachment part 21 for attaching a filter, and an operation part 22 for opening and closing the attachment part 21. FIG. 3 illustrates the attachment part 21 when it is open. The attachment part is formed by a receiving portion 23, an adapter set on the receiving portion 23, and a pressing portion 24. After an extraction filter is set on the receiving portion 23 via the adapter, the extraction filter is pressed by the pressing portion 24, so that it is stably held. For attaching the filter attachment kit 2 to the espresso machine 1, the pressing portion 24 is pressed upward from below and the filter attachment kit 2 is turned rightward to be locked and retained. To remove the kit, it is turned in the opposite direction.

An extraction filter for espresso coffee may be set on the receiving portion 23 via an adapter (not shown) dedicated for extracting espresso coffee. An extraction filter for drip coffee may be set on the receiving portion 23 via a dedicated adapter 3 that is different from the one mentioned above.

The adapter 3 is formed in a ring-like shape so that an extraction filter for drip coffee to be described later can be set on the ring-like portion. The receiving portion 23 has circular arc protruded walls 23*a* so that the adapter 3 can be positioned on the protruded walls 23*a*.

<Structure of Extraction Filter>

Next, the structure of the extraction filter according to this embodiment will be described. This extraction filter is originally for drip coffee and can be attached to a drip machine. The extraction filter has a unique structure so that it can be used also in the espresso machine of FIG. 1.

Figure 4:
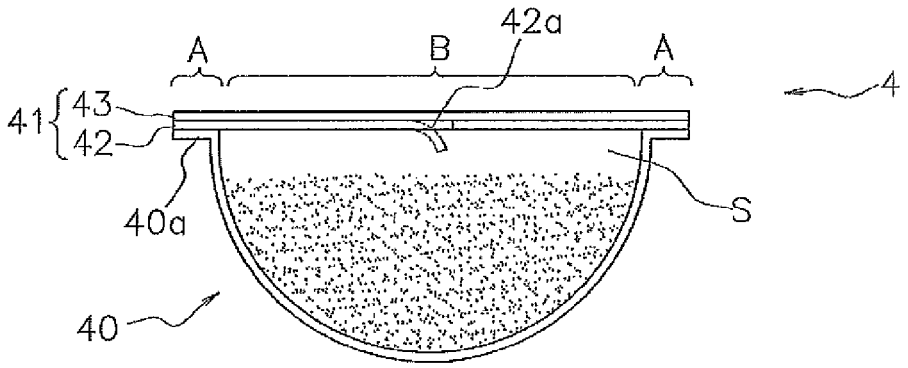
FIG. 4 is a diagram illustrating a cross section of an extraction filter.
Figure 5:
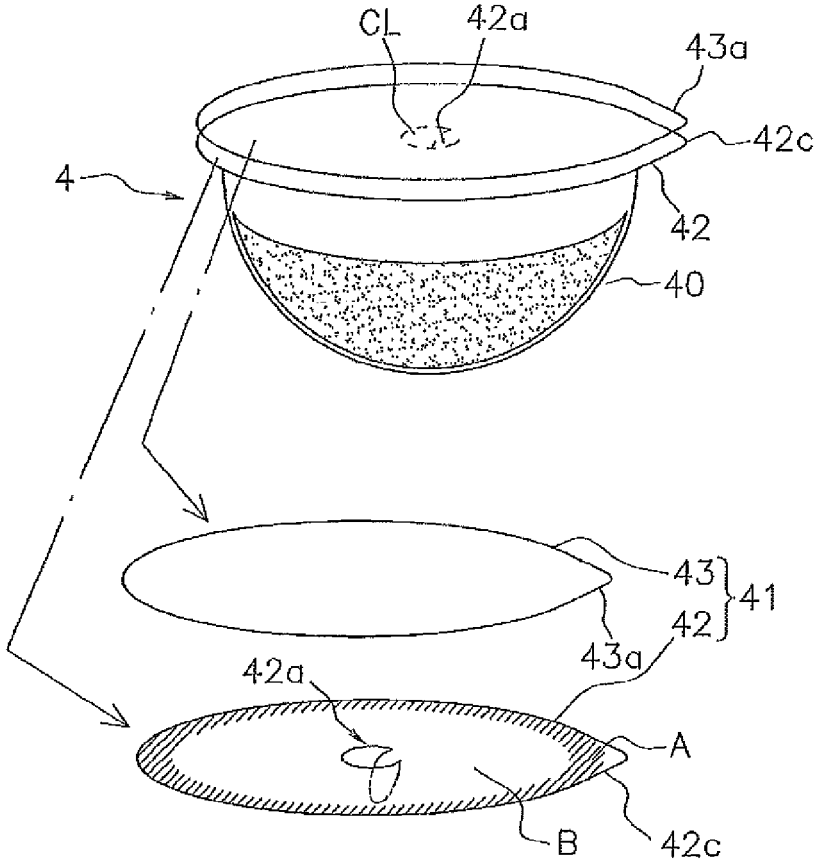
FIG. 5 is an exploded perspective view illustrating the constituent elements of the extraction filter.

FIG. 4 is a diagram illustrating a cross section of the extraction filter. FIG. 5 is an exploded perspective view illustrating the constituent elements of the extraction filter. An extraction filter 4 is formed by a filter part 40 containing coffee powder (i.e., article consumed for enjoyment), and a flat plate-like lid 41 attached to an upper portion of this filter part 40.

The lid 41 is configured to have a double-layer structure including a non-water permeable first sheet member 42 located adjacent the filter part 40, and a water permeable second sheet member 43 laminated on this first sheet member 42. The filter part 40 is made of a non-woven fabric, and preferably of a spunbonded non-woven fabric. Some space S is formed in an upper part of the filter part 40. This space S allows the coffee powder swollen by hot water to make stagnant contact with water, whereby coffee can be fully extracted.

The first sheet member 42 is formed of a single layer or multilayer resin film. The second sheet member 43 is formed of a non-woven fabric such as a spunbonded non-woven fabric. The filter part 40 has a flange 40*a* so that it is bonded to the lid 41 at this flange 40*a*. The first sheet member 42 and the second sheet member 43 are also bonded to each other only at their peripheral edge portions A (see hatched portion in FIG. 5) and not bonded in the center portion B. As the first sheet member 42 and the second sheet member 43 are not bonded to each other in the center portion B, there can be formed a space (gap) between them.

A tongue-shaped hole 42*a* is formed in the center of the first sheet member 42. Such a hole 42*a* can be formed by providing a cut line CL in the first sheet member 42 during the production process. The hole 42*a* may be formed by punching instead of providing the cut line CL, which will, however, produce small waste pieces and may lead to problems due to foreign material mixing. The formation of the cut line CL thus prevents production of waste pieces and such problems as mentioned above. The hole 42*a* has a diameter of about 3 mm.

Tabs 42*c* and 43*a* are integrally formed to the first sheet member 42 and the second sheet member 43, respectively, to provide an easy hold.

The cut line CL is in a C-shape (i.e., predetermined shape) in this embodiment, but may take any other suitable shapes such as a V-shape, etc.

The material for the first sheet member 42 may be, for example, a single-layer film of CPP (cast polypropylene) (50 μm thickness), a three-layer film of PE (polyethylene)/PP (polypropylene)/PE (50 μm thickness in total), or a three-layer film of PP/PP/PP (50 μm thickness in total) and the like. The material may be selected suitably in consideration of the quality of the extracted liquid, bond properties and strength, etc of the sheets.

The material forming the filter part 40 may be, for example, spunbonded fabric Y25200 produced by Asahi Kasei Fibers Corporation. The material forming the second sheet member 43 may be, for example, OKILON CEW-30 produced by Ohki Co., Ltd.

<Extraction Operation>

Figure 6:
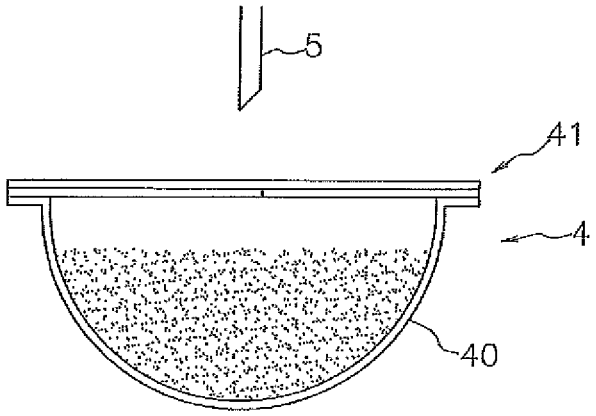
FIG. 6 is a diagram illustrating the operation of extracting coffee (with a drip machine).
Figure 6:
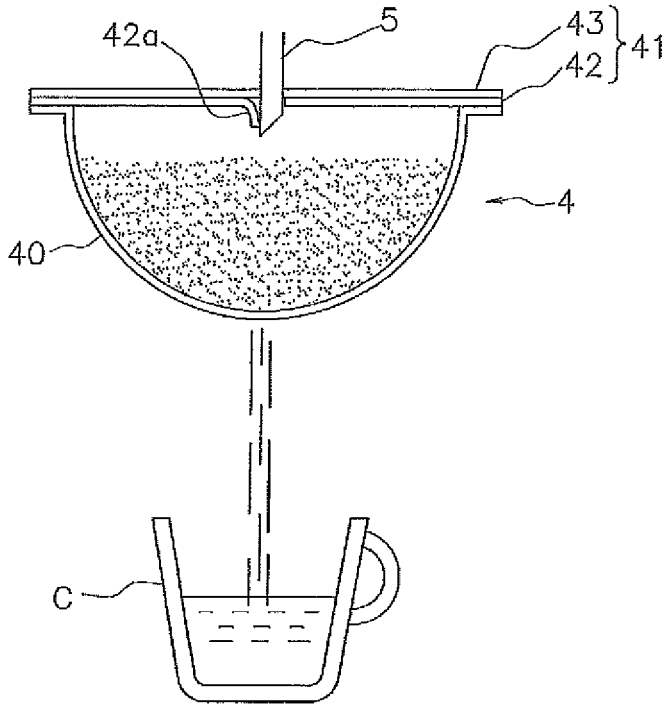

Next, the operation of extracting coffee using the extraction filter shown in FIG. 4 will be described. FIG. 6 illustrates the operation of extracting coffee with a drip machine. Hot water is poured through a nozzle 5. FIG. 6(*a*) shows the state before starting extraction. For extraction, the nozzle 5 comes down and goes through the lid 41. As the nozzle 5 comes down, it pierces the second sheet member 43 of the lid 41, while it bends down the tongue-shaped portion of the hole 42*a* of the first sheet member 42. When the nozzle 5 has been lowered to a predetermined position, it dispenses hot water from its tip. Thus extracted coffee is poured into the coffee cup C.

Figure 7:
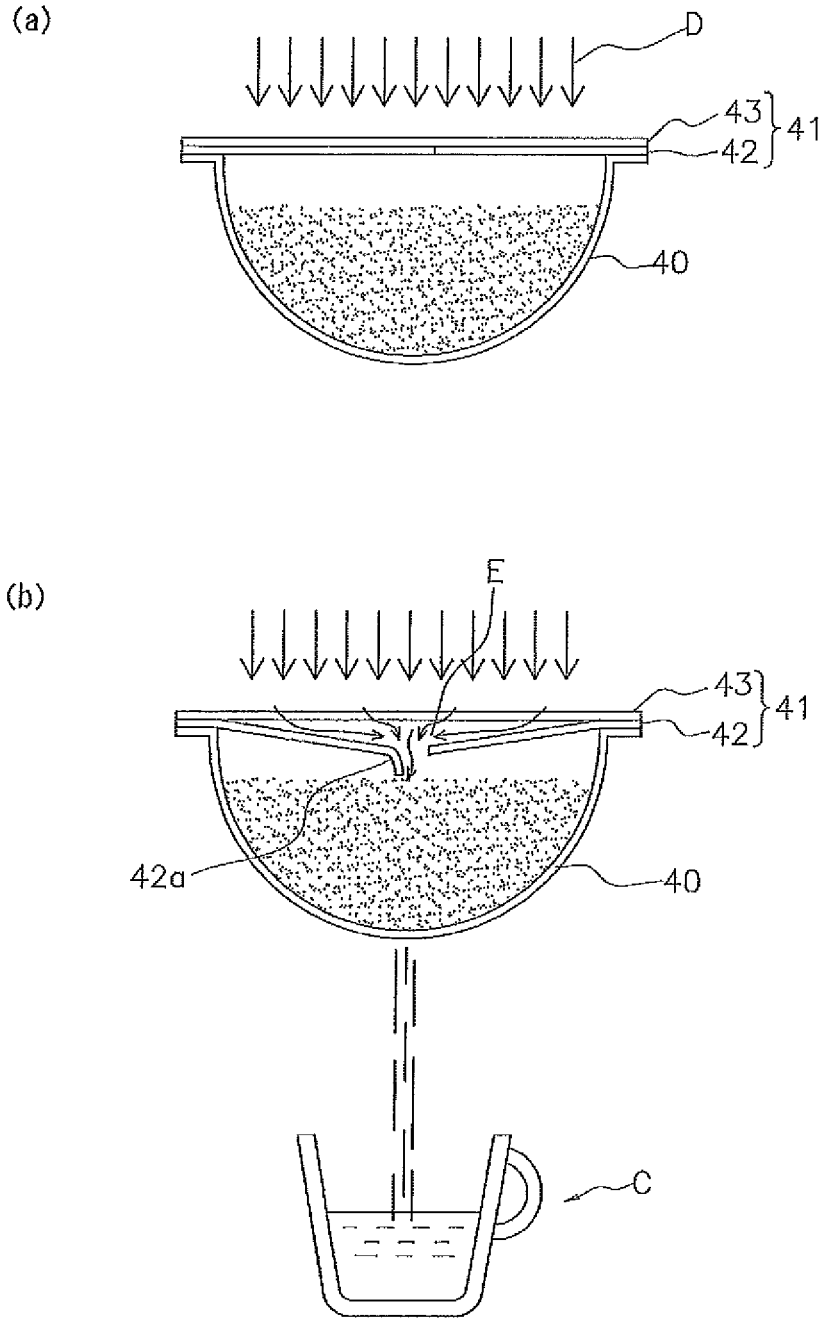
FIG. 7 is a diagram illustrating the operation of extracting coffee (with an espresso machine).

Next, the operation of extracting drip coffee with an espresso machine will be described with reference to FIG. 7. Hot water is poured all over the lid 41 as shown in FIG. 7(*a*) (see arrows D). The hot water poured onto the edge of the lid 41 tends to flow toward the hole 42*a* in the center as shown in FIG. 7(*b*). As the second sheet member 43 on the upper side of the lid 41 is made of a non-woven fabric, the hot water easily permeates it and does not stay on the top of the lid 41.

Since the first sheet member 42 and the second sheet member 43 are bonded together only at the peripheral edge portion, a space (gap) E is readily formed therebetween by the pressure of hot water. The priming action of the hot water introduced in this space E can reduce accumulation of hot water on the top of the lid 41.

If the lid 41 were formed of the second sheet member 43 alone in a single layer, hot water would be poured from all over the lid, which would make the coffee weak and deteriorate its taste. With the present invention, as the hot water is poured from the hole 42*a* in the center, it is uniformly applied, which makes highly reproducible extraction of coffee possible. Thus stable-quality, tasty drip coffee can be extracted even with the use of an espresso machine.

<Production Process Of Extraction Filter>

Figure 8:
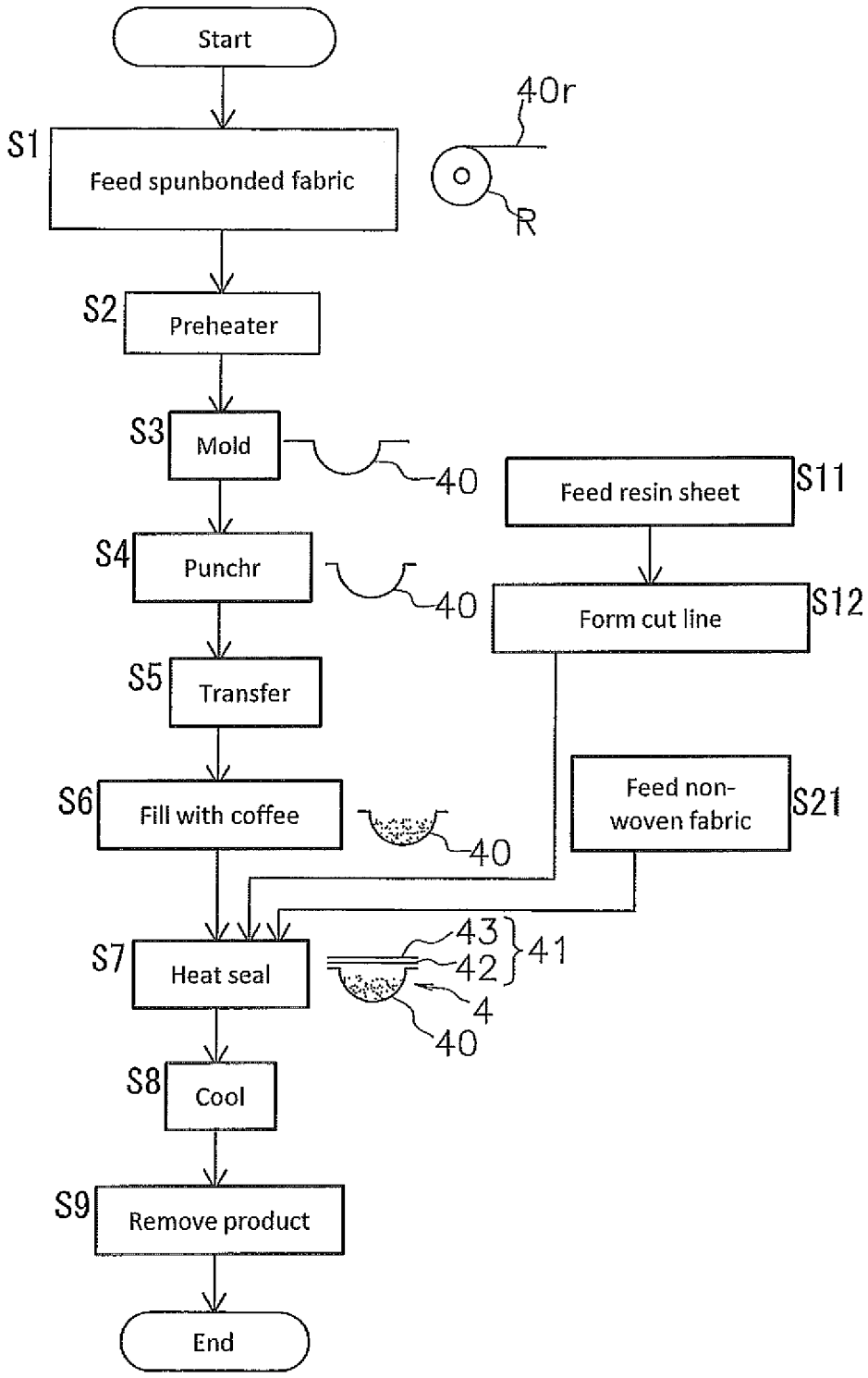
FIG. 8 is a diagram illustrating one example of the process of producing the extraction filter.

Next, one example of the process of producing the extraction filter according to the present invention will be described using the flowchart of FIG. 8. First, to form the filter part 40 of the extraction filter 4, a roll R of a strip of spunbonded non-woven fabric is set, and the strip of spunbonded non-woven fabric 40R is reeled out from the roll (S1). Next, this non-woven fabric 40R is heated with a preheater to a predetermined temperature (S2).

Next, the sheet-like non-woven fabric 40R is formed into the bowl-shaped filter part 40 with the use of dies (S3). The structure of the dies for the molding will be described later. Next, punching is performed (S4). Thus the filter part 40 alone is removed from the sheet-like non-woven fabric 40R. The punched filter part 40 is transferred to a next process step (S5).

Next, the filter part 40 is filled with coffee powder (S6). Meanwhile, a resin sheet that will form the first sheet member 42 is fed in a different process step (S11). The cut line CL is formed in the resin sheet (S12). Non-woven fabric that will form the second sheet member 43 is also fed (S21). The sheets are punched out to respective sizes corresponding to the lid 41, and bonded together by a heat seal (S7). That is, with the peripheral edges of the first sheet member 42 and the second sheet member 43 overlapped on the flange 40*a* of the filter part 40, they are thermally sealed. After being thermally sealed and cooled (S8), the coffee extraction filter is taken out as the product (S9).

<Die Structure>

Figure 9:
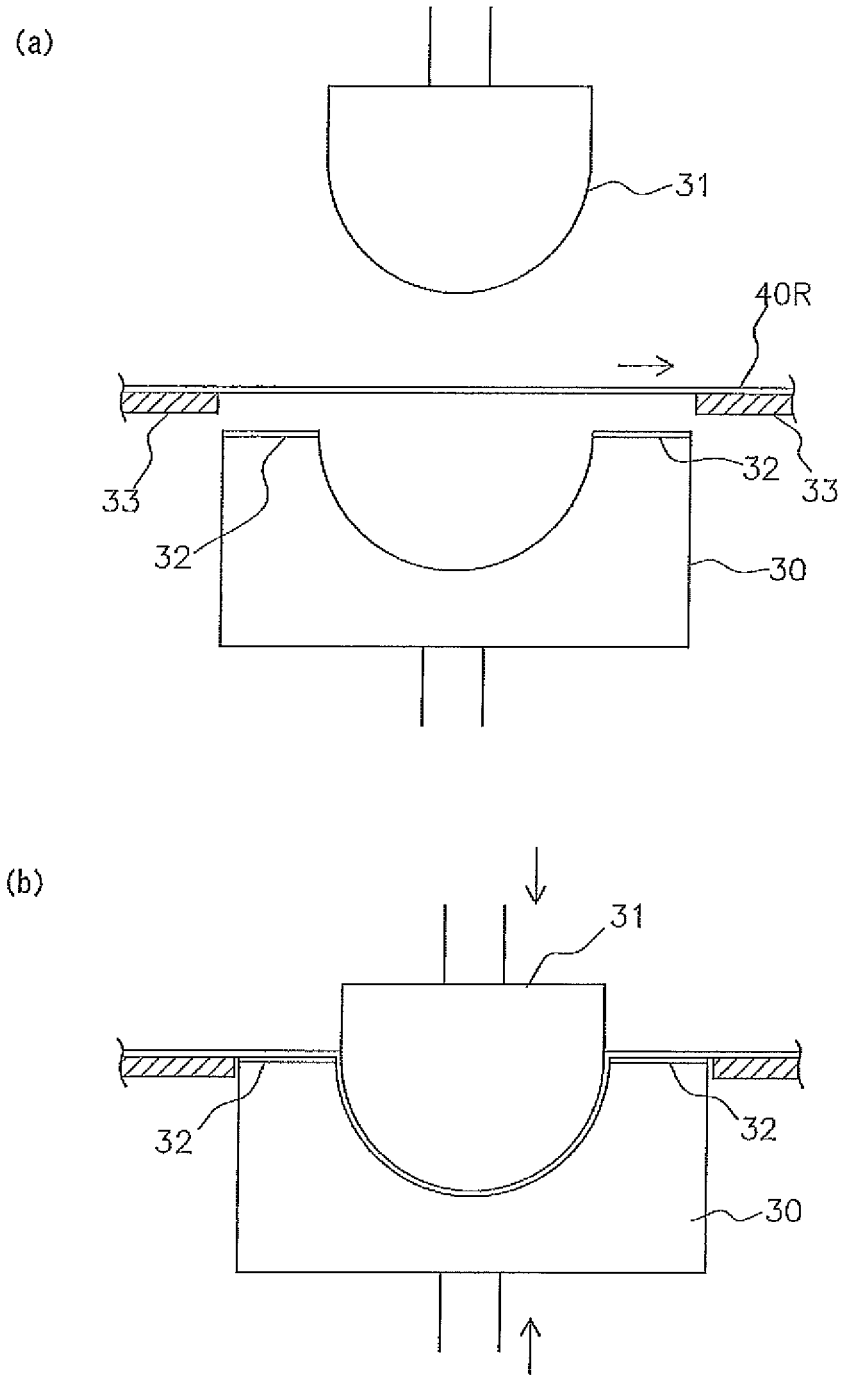
FIG. 9 is a diagram illustrating the structure of dies used in the production process of the extraction filter.

FIG. 9 is a diagram illustrating the structure of dies used in the process step S3. The strip of non-woven fabric 40R is transferred from left to right in the drawing. FIG. 9(*a*) illustrates the state before the molding, and FIG. 9(*b*) illustrates the state after the molding. The dies are formed of a female die 30 disposed on one side of the non-woven fabric 40R and a male die 31 disposed on the other side. The dies are operated, with both of the female die 30 and the male die 31 being heated to 155° C. The dies 30 and 31 are both made of aluminum alloy.

If the male die 31 alone is heated to 155° C., heat will not be conducted entirely to the filter part 40 being molded, so that there is a possibility of some stress remaining inside. If this is the case, the filter part 40 may shrink its height during actual extraction of coffee, whereby the stagnant contact space above the coffee powder may not be formed. This will result in extracting of tasteless coffee. Such a problem is avoided by heating both dies 30 and 31 to 155° C.

A slip prevention sheet 32 is provided on the surface of the female die 30 to prevent the non-woven fabric 40R from slipping during the molding. A material such as sandpaper, for example, may be bonded to the die surface.

Other Embodiments

While this embodiment has been described with an example of using the extraction filter for drip coffee in an espresso machine, the present invention is not limited to such an application. The extraction filter for tea or green tea may also be used in the espresso machine, or other types of extraction machines.

DESCRIPTION OF REFERENCE SIGNS

A peripheral edge portion
B center portion
S space
1 espresso machine
2 filter attachment kit
3 adapter
4 extraction filter
40 filter part
40*a* flange
40R strip of non-woven fabric
41 lid
42 first sheet member
42*a* hole
43 second sheet member

The invention claimed is:

1. A beverage extraction filter, comprising:

a filter part containing an article consumed for enjoyment for extraction by hot water passing through the filter part, said article being the only article included in the beverage extraction filter, and a flat plate-like lid attached to an upper portion of the filter part, wherein the lid has a laminated structure consisting of a non-water permeable first sheet member located adjacent to the filter part, and a water permeable second sheet member laminated on the first sheet member opposite the filter part, and an upper face of the second sheet member is exposed for use, and the first sheet member has a hole formed in a center thereof for hot water to pass therethrough for extraction of the article.

2. The beverage extraction filter according to claim 1, wherein the first sheet member and the second sheet member are laminated upon one another, and bonded together only at a peripheral edge portion.

3. The beverage extraction filter according to claim 2, wherein the hole is formed in a tongue shape by a cut line of a predetermined shape, so that, during extraction, a tongue-shaped portion in the hole deforms downward by pressure from hot water to let the hot water pass through the hole.

4. The beverage extraction filter according to claim 3, wherein the second sheet member is made of a non-woven fabric.

5. The beverage extraction filter according to claim 4, wherein the first sheet member is formed of a resin film having a multilayer structure.

6. The beverage extraction filter according to claim 3, wherein the first sheet member is formed of a resin film having a multilayer structure.

7. The beverage extraction filter according to claim 2, wherein the second sheet member is made of a non-woven fabric.

8. The beverage extraction filter according to claim 7, wherein the first sheet member is formed of a resin film having a multilayer structure.

9. The beverage extraction filter according to claim 2, wherein the first sheet member is formed of a resin film having a multilayer structure.

10. The beverage extraction filter according to claim 1, wherein the hole is formed in a tongue shape by a cut line of a predetermined shape, so that, during extraction, a tongue-shaped portion in the hole deforms downward by pressure from hot water to let the hot water pass through the hole.

11. The beverage extraction filter according to claim 10, wherein the second sheet member is made of a non-woven fabric.

12. The beverage extraction filter according to claim 11, wherein the first sheet member is formed of a resin film having a multilayer structure.

13. The beverage extraction filter according to claim 10, wherein the first sheet member is formed of a resin film having a multilayer structure.

14. The beverage extraction filter according to claim 1, wherein the second sheet member is made of a non-woven fabric.

15. The beverage extraction filter according to claim 14, wherein the first sheet member is formed of a resin film having a multilayer structure.

16. The beverage extraction filter according to claim 1, wherein the first sheet member is formed of a resin film having a multilayer structure.

* * * * *